US007855620B2

(12) United States Patent
Kayano

(10) Patent No.: US 7,855,620 B2
(45) Date of Patent: Dec. 21, 2010

(54) FILTER CIRCUIT DEVICE HAVING PARALLEL CONNECTED RESONATOR GROUPS WITH CASCADE CONNECTED DELAY CIRCUITS AND RADIO COMMUNICATION DEVICE FORMED THEREFROM

(75) Inventor: Hiroyuki Kayano, Fujisawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 160 days.

(21) Appl. No.: 11/477,435

(22) Filed: Jun. 30, 2006

(65) Prior Publication Data

US 2007/0001787 A1 Jan. 4, 2007

(30) Foreign Application Priority Data

Jul. 4, 2005 (JP) ..... 2005-195190

(51) Int. Cl.
*H01P 1/20* (2006.01)
*H01P 1/203* (2006.01)
*H01B 12/02* (2006.01)

(52) U.S. Cl. ..... 333/202; 333/204; 333/99 S

(58) Field of Classification Search ..... 333/134, 333/175, 202, 204, 99 S
See application file for complete search history.

(56) References Cited

U.S. PATENT DOCUMENTS 4,396,893 A * 8/1983 Edson ..... 333/17.2
5,184,096 A * 2/1993 Wakino et al. ..... 333/175
6,518,854 B2 2/2003 Kayano et al.
6,759,930 B2 7/2004 Kayano et al.
6,914,497 B2 * 7/2005 Sano et al. ..... 333/175
7,262,677 B2 * 8/2007 Kubota et al. ..... 333/204
7,295,090 B2 * 11/2007 Kayano et al. ..... 333/202
2005/0285701 A1 12/2005 Kayano et al.
2008/0068113 A1 * 3/2008 Kayano ..... 333/99 S

FOREIGN PATENT DOCUMENTS

JP 63-204801 8/1988

(Continued)

OTHER PUBLICATIONS

Mitsuru Honjoh, et al., "Synthesis of Microwave Circuits by Normal Mode Expansion—Synthesis of Rectangular Waveguide Filter with Dielectric Sheet Window", IEICE Technical Report, MW82-54, 1982, pp. 9-16.

(Continued)

*Primary Examiner*—Benny Lee
(74) *Attorney, Agent, or Firm*—Oblon, Spivak, McClelland, Maier & Neustadt, L.L.P.

(57) ABSTRACT

A filter circuit device includes a resonator unit configured with six or more resonators, the resonators being divided into a first resonator group including resonators connected in parallel and having odd-numbered resonance frequencies and a second resonator group connected to the first resonator group in parallel and including resonators connected in parallel and having even-numbered resonance frequencies, a delay unit connected between the first and second resonator groups to make a phase difference in a range of (180±30)+360×j degrees (j is a natural number) between the first and second resonator groups, a power dividing unit configured to divide a power to the resonators, and a power combining unit configured to combine outputs of the resonators of the first and second resonator groups between which the phase difference is made.

7 Claims, 8 Drawing Sheets

FOREIGN PATENT DOCUMENTS

| | | |
|---|---|---|
| JP | 11-330803 | 11/1999 |
| JP | 2001-345601 | 12/2001 |

OTHER PUBLICATIONS

Takayuki Kato, et al., "Studies on the equivalent circuits of dual-mode rectangular waveguide filters using HFFS and MDS", IEICE Technical Report, MW-98-95, Sep. 1998, pp. 73-80.

U.S. Appl. No. 11/776,758, filed Jul. 12, 2007, Kayano.
U.S. Appl. No. 11/856,321, filed Sep. 17, 2007, Kayano, et al.
U.S. Appl. No. 11/534,069, filed Sep. 21, 2006, Kayano.
U.S. Appl. No. 11/534,368, filed Sep. 22, 2006, Kayano.
U.S. Appl. No. 12/199,248, filed Aug. 27, 2008, Kayano, et al.
U.S. Appl. No. 12/235,951, filed Sep. 23, 2008, Kayano.

* cited by examiner

FIG. 4A
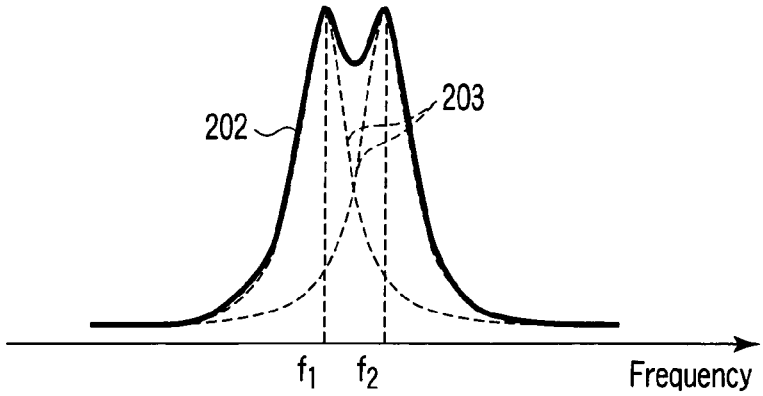
FIG. 4B
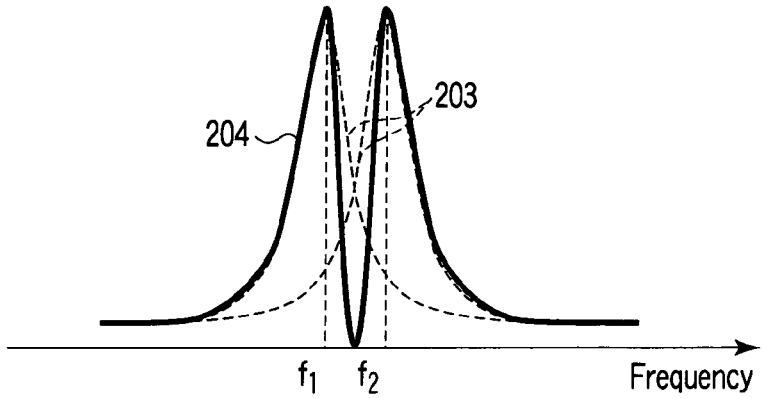
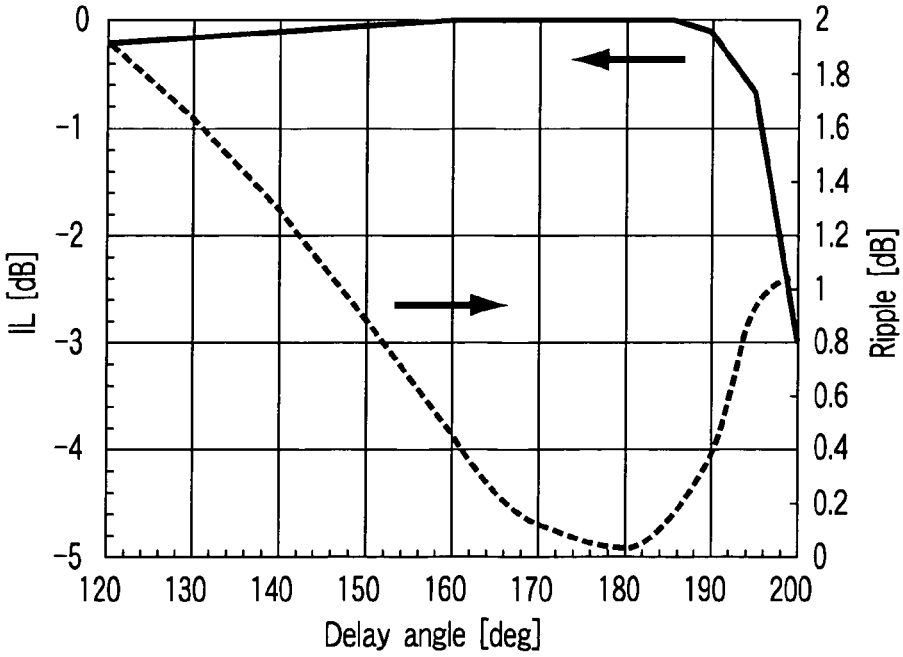
FIG. 5

FILTER CIRCUIT DEVICE HAVING PARALLEL CONNECTED RESONATOR GROUPS WITH CASCADE CONNECTED DELAY CIRCUITS AND RADIO COMMUNICATION DEVICE FORMED THEREFROM

CROSS-REFERENCE TO RELATED APPLICATIONS

This application is based upon and claims the benefit of priority from prior Japanese Patent Application No. 2005-195190, filed Jul. 4, 2005, the entire contents of which are incorporated herein by reference.

BACKGROUND OF THE INVENTION

1. Field of the Invention

The present invention relates to a filter circuit used for limiting a radio band of radio communications and a radio communication apparatus using the same.

2. Description of the Related Art

Generally, a filter circuit device comprises plural resonators connected in cascade. The resonator is configured with inductors and a capacitor. In the case that the effect of a loss is considered, a resistor is added to the resonator. The resonance frequency of the resonator when no resistor is provided is expressed by the following equation.

$$f0=1/sqrt(L\times C)$$

where L and C indicate an inductance and capacitance of the resonator respectively. It is possible to determine a pass frequency band and a decay quantity of the filter circuit by connecting the resonators in cascade and determining adequately coupling factors (m2, m3) representing a coupling quantity between the resonators and external Qs (m1, m4) representing a quantity by which the resonator excites an input/output port.

A real filter circuit comprises a filter circuit using as a resonator a three-dimensional circuit such as a filter configured with a metal cavity or a filter configured with a cylindrical metal cavity in which a dielectric material is inserted. Alternatively, it comprises a filter circuit using a distributed constant circuit such as a filter configured with a microstrip line or a resonator of a plane circuit or a lumped constant circuit configured with circuit constants such as an inductor or a capacitor. There is a filter using a microstrip line resonator as an example of the filter. This filter uses three microstrip line resonators of a half-wave length, which are arranged such that their outputs are shifted by a quarter-wave. The distance between the resonators determines the coupling factor between the resonators.

The excitation lines on the input and output sides are arranged at a distance realizing a desired external Q with respect to the resonator. Many of these filters each comprise plural resonators all connected in cascade. Substantially the same electric energy passes through all resonators. However, the electric energies passing through the resonators slightly differ due to respective losses contained in the resonators. Therefore, it is important that a filter passing through a high electric energy has a structure for radiating heat due to the loss of the resonator. The filter of high energy resistance performance has a large size, and uses a filter using a three-dimensional circuit which is excellent in low loss characteristics and radiation characteristics. Conventionally, the filter size can be decreased in order of a three-dimensional circuit, a distributed constant circuit and a lumped constant circuit. However, there is a problem that a loss increases and a heat radiation characteristic deteriorates.

There is a method of configuring a filter of lower loss than the three-dimensional circuit with a microstrip line filter using a superconductor to realize a low loss and a small size. The filter configured with microstrip line resonators connected in cascade, each resonator having a length of a half-wave length of a desired frequency, is known (Takayuki Kato, Kenji Yamanaka, Zhewang Ma, Yoshio Kobayashi, "Studies on the equivalent circuits of dual-mode rectangular waveguide filters using HFSS and MDS" Faculty of Engineering, Saitama University, MW 98-85, pp. 73-80, Sep. 1998). However, in the microstrip line resonator, an electric field concentrates on the sectional edge of the line through which a signal power passes, so that an electric current concentrates thereon. For this reason, there is a problem that, if the high power passes through the filter, the current flowing through the edge with the power of several watts exceeds a limiting value of the critical current density of the superconductor, resulting in damaging the superconducting characteristic.

A filter configured with resonators connected in parallel in order to reduce heat radiation for the filter using the three-dimensional circuit is known (Japanese Patent Laid-Open No. 2001-345601). A filter improving a power handling capability as a whole is realized by distributing a power supplied by a parallel structure of resonators to each resonator. If the resonators are configured to have different frequencies for realizing a parallel structure of the resonators and the resonators having adjacent resonance frequencies are configured so as to have a reversed phase, a filter with a desired filter property can be realized. However, it becomes difficult to make the resonators different in resonance frequency with the three-dimensional circuit to realize such a filter.

To perform detection in reversed phase with the three-dimensional circuit can be realized by carrying out detection in an electric field mode for making the reversed phase or by reversing a direction of a loop antenna for detecting a magnetic field. However, it is impossible to perform detection in reversed phase in a case of using the distributed constant circuit and lumped constant circuit. Therefore, a filter structure becomes large in size when the resonators are connected in parallel. Further, if the resonators are configured with microstrip lines and connected in parallel, a set of a resonator and a delay line more than 180 degrees is needed, thereby to increase a circuit scale.

As mentioned above, in a conventional filter configured with resonators connected in cascade, when a high electric energy is supplied to a filter, the high electric energy passes through all resonators. As a result, it is difficult to obtain a high power handling capability. In particular, in the filter using microstrip line resonators, when the high electric energy passes through the filter, a current concentrates at edge of the signal line. As a result, the concentrated current exceeds the critical current density of the superconductor, resulting in damaging the superconducting characteristic. Further, a delay circuit for realizing an reversed phase increases in size for the resonators to be connected in parallel.

An object of the present invention is to provide a filter circuit capable of decreasing in size by connecting resonators in parallel even if a resonance circuit of a distributed constant circuit or a lumped constant circuit is used.

SUMMARY OF THE INVENTION

An aspect of the present invention provides a filter circuit device comprising: a resonator unit configured with six or more resonators having ordered resonance frequencies respectively, the resonators being divided into a first resonator group including several resonators of the resonators connected in parallel and having odd-numbered resonance frequencies and a second resonator group connected to the first resonator group in parallel and including remaining resonators of the resonators connected in parallel and having even-numbered resonance frequencies; a delay unit connected in cascade between the first resonator group and the second resonator group to make a phase difference in a range of (180±30)+360×j degrees (j is a natural number) between the first resonator group and the second resonator group; a power dividing unit configured to divide a power to the resonators; and a power combining unit configured to combine outputs of the resonators of the first resonator group and the second resonator group between which the phase difference is made by the delay unit.

BRIEF DESCRIPTION OF THE DRAWINGS

FIGS. 4A and 4B are diagrams indicating a frequency response characteristic of the embodiment shown in FIG. 3.

FIG. 5 is a diagram indicating an insertion loss and ripple characteristic with respect to a delay phase angle.

DETAILED DESCRIPTION OF THE INVENTION

Figure 1:
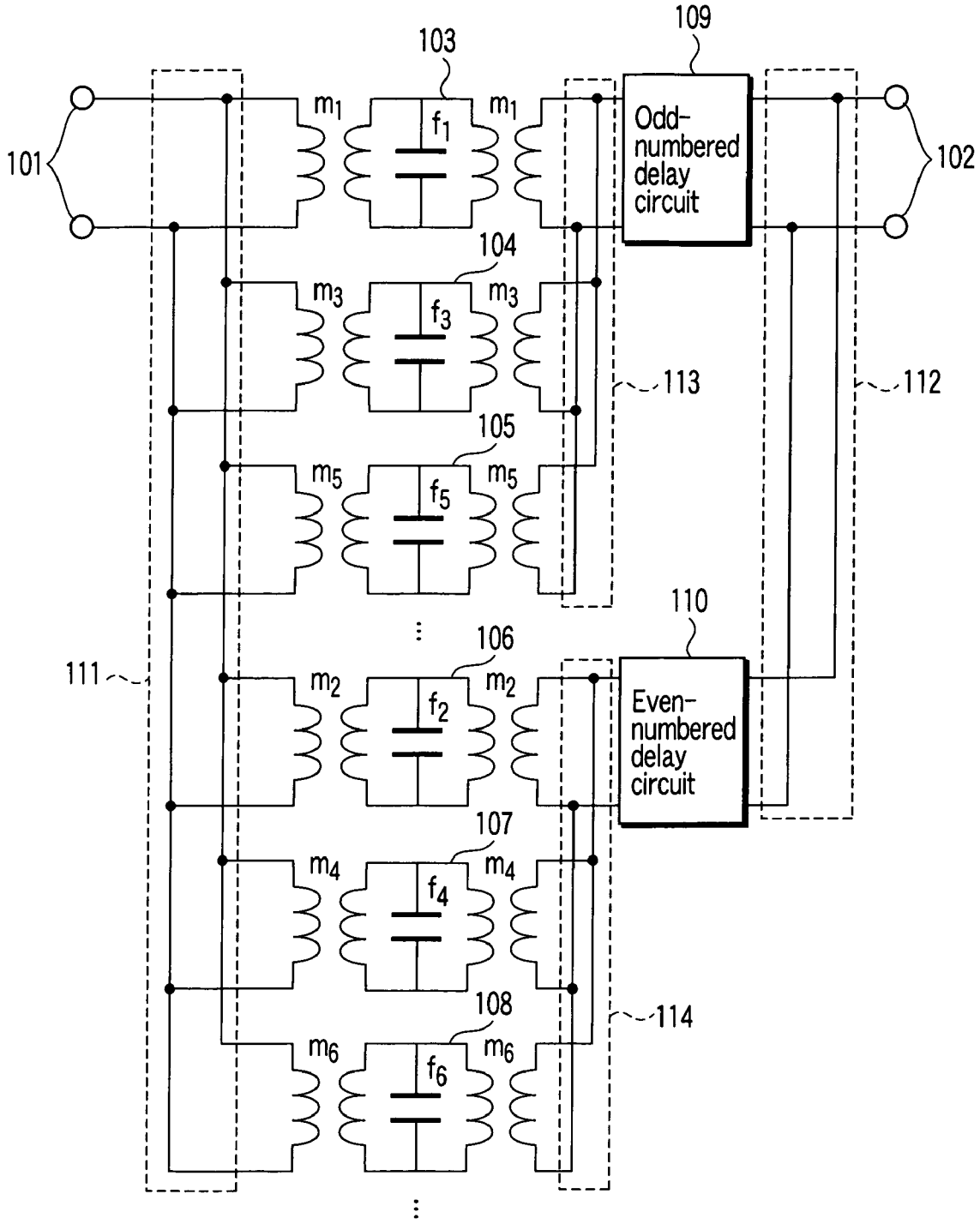
FIG. 1 shows a circuit diagram of a filter circuit according to the first embodiment of the present invention.

FIG. 1 shows a filter circuit related to a first embodiment of the present invention. Throughout the figures like features in the different drawing figures are designated by the same reference label and may not be described with respect to all the drawing figures in which they appear. According to the filter circuit shown in FIG. 1, 2*n* (n is an integer more than 2) resonators (more than 6 resonators) having different frequencies f1, f2, f3, f4, f5, f6, . . . , for example, resonators 103, 104, 105, 106, 107 and 108 are arranged in order of increasing resonance frequency. In this case, the resonators are divided into two resonator groups of the even-numbered resonators 106, 107 and 108 and the odd-numbered resonators 103, 104 and 105, and connected in parallel. The outputs of the resonators of each of the resonator groups are combined with corresponding one of power combining circuits 113 and 114. Respective odd-numbered and even-numbered delay circuits 109 and 110 connected in cascade to the resonator groups respectively make a phase difference relation in an range of (180±30)+360×j degree (j is a natural number). A power dividing circuit 111 for connecting the resonators of the resonator groups in parallel and a power combining circuit 112 for combining the outputs of the delay circuits 109 and 110 are provided. The above configuration can provide the same result even if the input 101 and the output 102 are reversed.

The filter circuit of FIG. 1 comprises the even number of resonators 103-108, but it may comprise the odd number of resonators.

Figure 2:
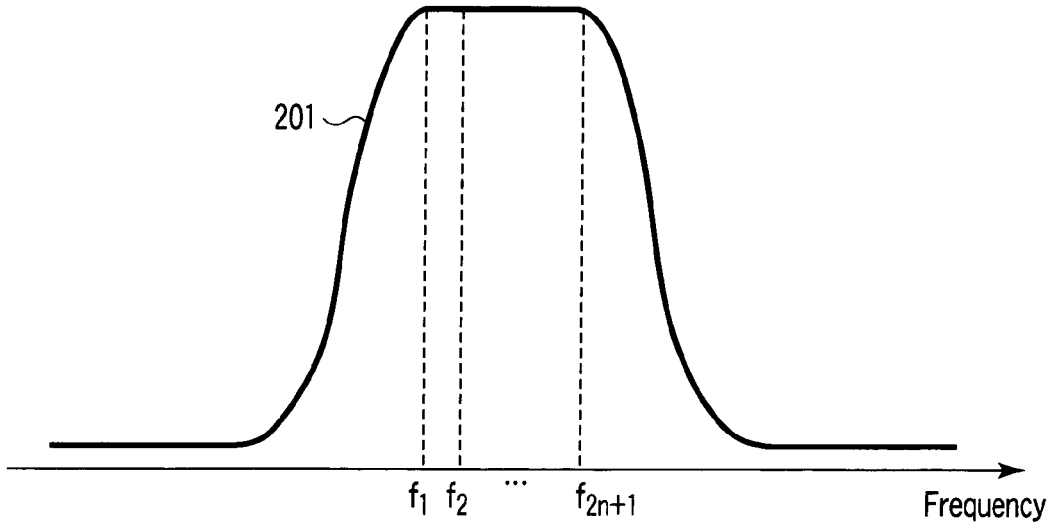
FIG. 2 is a diagram showing a frequency response characteristic of the first embodiment of FIG. 1.

FIG. 2 shows a frequency response 201 along a frequency axis from the input terminal 101 to the output terminal 102 of FIG. 1 including at frequencies f1, f2 . . . f2*n*+1. There will now be described a principle of the operation of the filter circuit referring to the filter circuit having only two resonators 103 and 106 as shown in FIG. 3.

Figure 3:
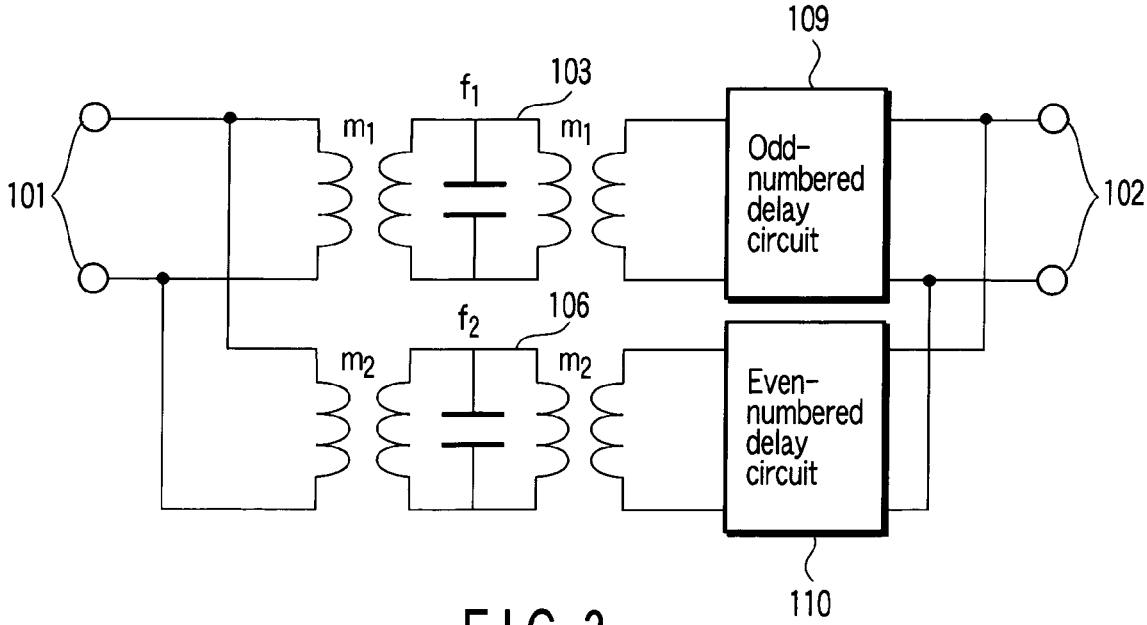
FIG. 3 is a circuit diagram illustrating a principle of a filter circuit of the present invention.

In the filter circuit of FIG. 3, the delay circuit 109 connected in cascade to the resonator 103 having a resonance frequency f1 and the delay circuit 110 connected in cascade to the resonator 106 having a resonance frequency f2 have a phase difference relation in the range of (180±30)+360×j degree (j is a natural number). The frequency response 202 along a frequency axis of this case is shown in FIG. 4A.

When the phase difference between the delay circuits 109 and 110 satisfies the above condition, the frequency response of the filter circuit is provided as a sum 202 of the frequency responses 203 of the resonators 103 and 106. A ripple between the resonance frequencies f1 and 12 viewed in the frequency responses 203 can be adjusted by the interval between the resonance frequencies f1 and 12 and mutual coupling factors m1 and m2 of the resonators 103 and 106 which are set to a suitable coupling amount (coupling factor) of FIG. 3.

The delay circuit 109 connected in cascade to the resonator 103 having the resonance frequency f1 and the delay circuit 110 connected in cascade to the resonator 106 having the resonance frequency 12 have a phase difference relation in the range of 360×j±30 degree (j is a natural number). The frequency response 204 along a frequency axis of this case is shown in FIG. 4B.

When the phase difference between the delay circuits 109 and 110 satisfies the above condition, the frequency response of the filter circuit is provided as a difference between the frequency responses 203 of each of the resonance circuits 103 and 106. The resonance frequencies f1, f2 may be at equal intervals or unequal intervals. The mutual coupling (m1, m2, m3, m4, m5, m6 . . . mi) (see e.g. FIG. 1) of each resonance circuit is in-phase coupling. Because there is no reversed phase coupling, the coupling can be realized by the distributed constant circuit and lumped constant circuit other than the three-dimensional circuit.

The passage range and out-of-band attenuation quantity of the frequency response 201 (FIG. 2) of the filter circuit are realized by adequately choosing quantities of the mutual coupling mi of the resonators 103 and 106 respectively. The mutual coupling mi may be a different coupling quantity or the same coupling quantity. The mutual coupling mi can determine the passage characteristics of the filter in association with a resonance frequency. In the circuit of FIG. 1, the input and output coupling quantities of the resonator are identical, but they may be different. Since the filter realizing such a circuit characteristic divides the passage power of the resonator and passes through the divided power, it has an excellent power handling capability in comparison with the conventional filter.

Even if the delay circuit is common to both resonators, it is shorter in a power-on time in comparison with the resonator. Therefore, the delay circuit does not influence the power handling capability. Such a point is beneficial in the case of applying to a microstrip line type filter circuit using a superconductor, and makes it possible to realize a filter circuit having a larger power handling capability greater than several watts with a small microstrip line type filter.

FIG. 5 shows an amplitude difference in Delay angle [deg] between resonance peaks (solid line) and a falling magnitude at the center frequency (dashed line) with respect to the phase difference of the circuit of FIG. 3. The amplitude difference is represented as the insertion loss IL of the filter property, and the falling magnitude at the center frequency is described as a ripple. Since the slope of this graph changes largely due to the shape of the resonator, this example is an example to which the present invention is applied.

It is necessary to decide a resonance frequency in the range that the insertion loss IL in this graph does not fall for the filter property to be obtained by a single delay circuit. For example, a resonator to resonate in a range of 150 to 185 degrees must be used when a filter of IL<−0.1 dB, for example, is made. In the filter property, the specification of 3 dB band width is used conventionally. Accordingly, the filter has only to be configured at a resonance frequency in a phase angle capable of realizing the insertion loss IL of 3 dB. In this filter configuration, a multistage filter can be configured with only a delay circuit by combining a 0-degree resonator and a 180-degree resonator. Accordingly, it is possible to decrease the occupied area of the filter circuit in comparison with a filter circuit having a need for delay circuits half of the number of conventional resonator stages.

Figure 6:
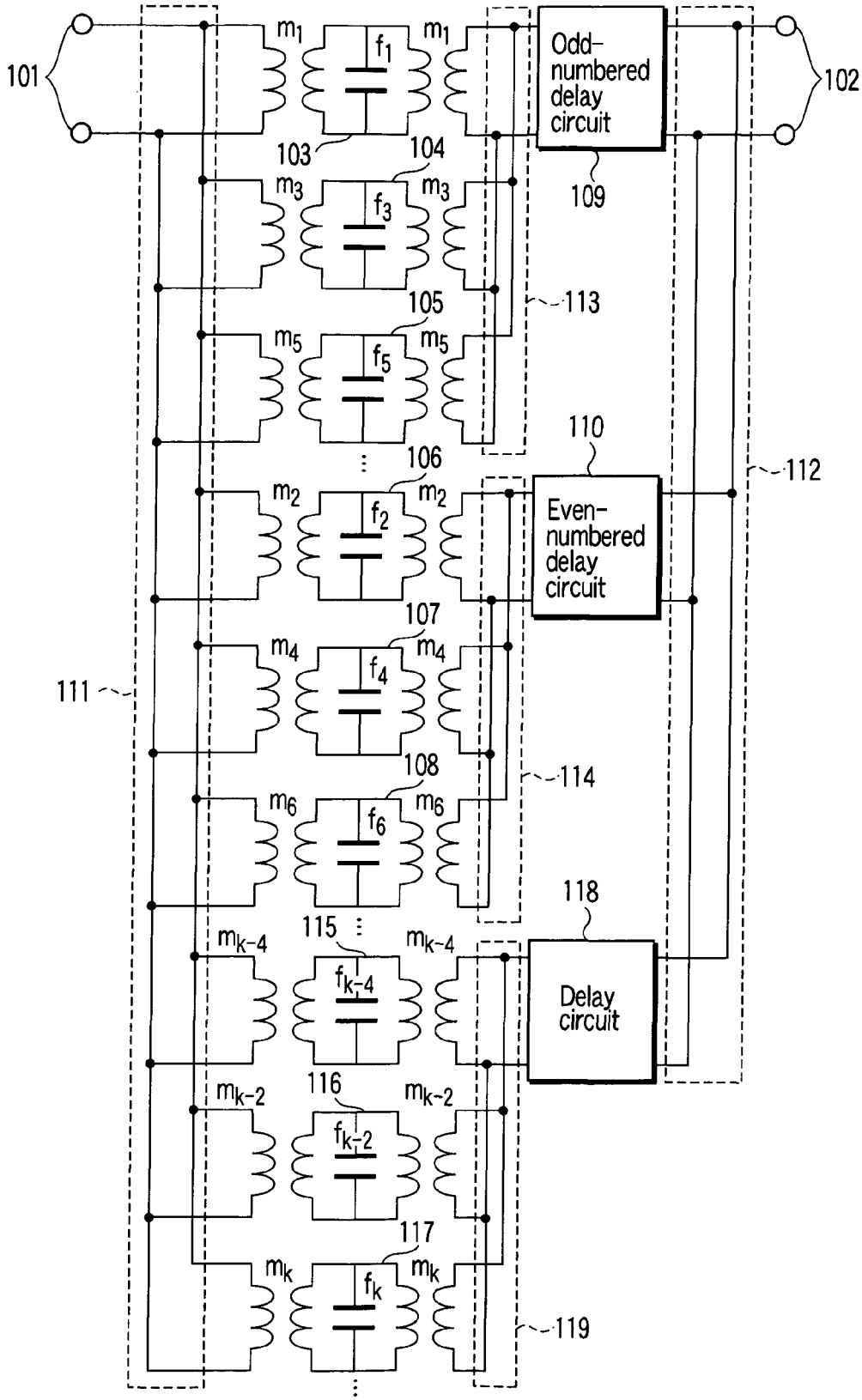
FIG. 6 is a circuit diagram of a filter circuit of the second embodiment of the present invention.

FIG. 6 shows a filter circuit of the second embodiment of the present invention. The filter circuit has three or more resonator groups. In other words, a resonator group of resonators 103, 104 and 105, a resonator group of resonators 106, 107 and 108 and a resonator group of resonators 115, 116 and 117 having frequencies fk-4, fk-2, fk and mutual couplings mk-4, mk-2, mk, respectively are provided. The input ports of these resonator groups are connected in parallel with a power dividing circuit 111, and the output ports are connected to power combining circuits 113, 114 and 119. The output ports of the power combining circuits 113, 114 and 119 are connected to the power combining circuit 112 through odd-numbered and even-numbered delay circuits 109, 110 and delay circuit 118 respectively.

As described above, there is a problem that the filter property could be realized only in a range of the delay phase angle that does not influence the insertion loss IL to use the delay circuit common to the resonators. However, in the present embodiment, since a plurality of resonator groups are provided, a filter of a broad band can be realized by changing the length of a delay circuit for making a delay phase angle. The resonators are divided into a lower resonator group and a higher resonator group with respect to the center of, for example, one filter property. In each resonator group, when the filter is configured by dividing the resonators into four resonator groups, each resonator group including the given number of resonators has a resonator frequency different from that of the other groups every two resonator frequencies. A filter having a small insertion loss IL and a wide band can be realized by comprising the low frequency resonance group with a delay circuit having a longer line than that of the high frequency resonance group.

Figure 7:
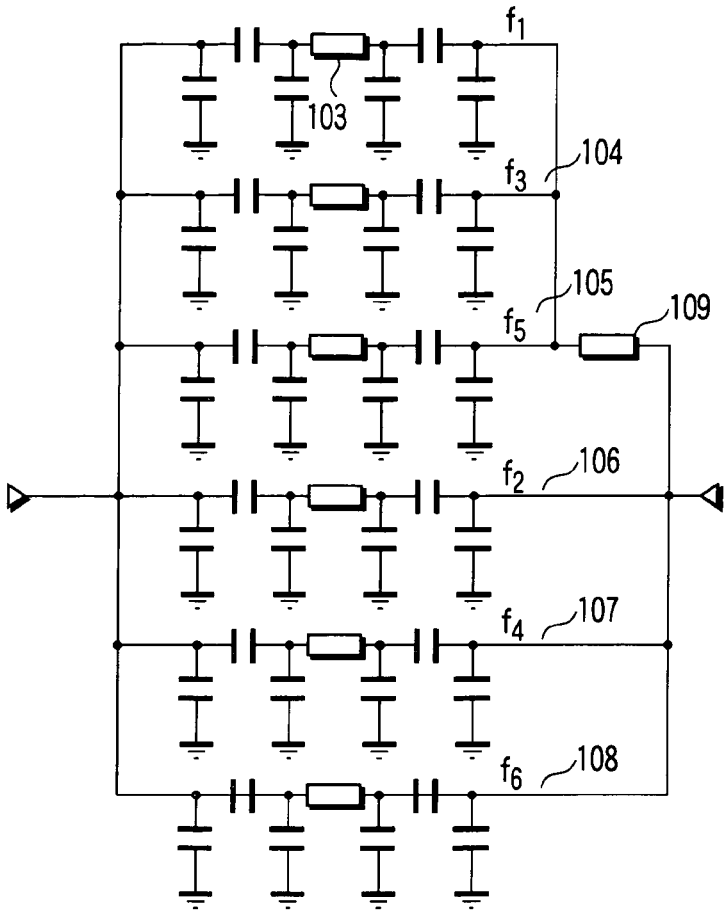
FIG. 7 is a circuit diagram of a filter circuit of the third embodiment of the present invention.
Figure 8:
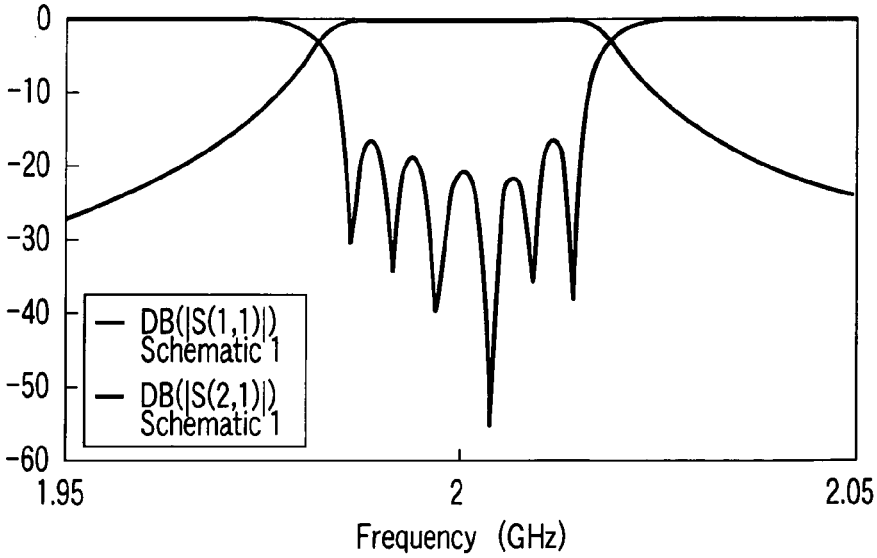
FIG. 8 is a diagram indicating the output of a filter circuit shown in FIG. 7.

FIG. 7 shows a filter circuit using 0- and 180 degree delay circuits according to the third embodiment of the present invention. The filter circuit has a center frequency of 2 GHz (see also FIG. 8) and is configured with six resonators 103, 104, 105, 106, 107 and 108. The resonance frequencies f1, f2, f3, f4, f5 and f6 of these resonators 103, 104, 105, 106, 107 and 108 are set at 1.9812 GHz, 1.988 GHz, 1.9953 GHz, 2.0047 GHz, 2.012 GHz and 2.0188 GHz respectively. In the present embodiment, the 180-degree delay circuit 109 is provided, but the 0-degree delay circuit is omitted. Accordingly, the filter can be realized with one delay circuit. The output characteristic at the frequencies between 1.95 GHz and 2.05 GHz of this filter circuit is shown in FIG. 8.

Figure 9:
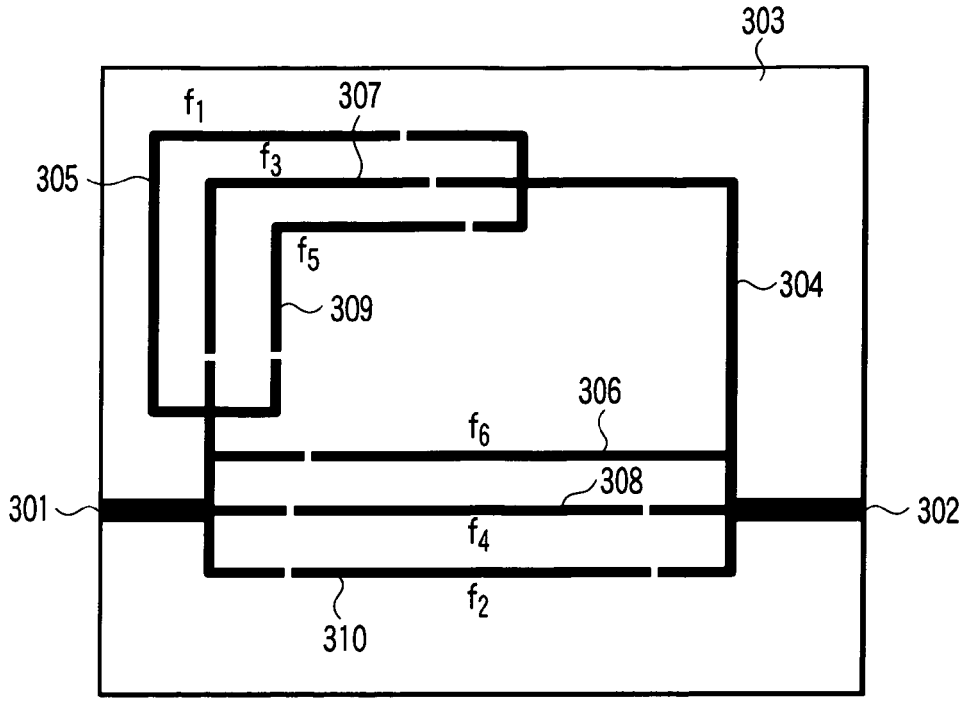
FIG. 9 shows a configuration of a filter circuit of the first concrete example of the third embodiment.

FIG. 9 shows a first concrete example of the filter circuit related to the third embodiment. The filter circuit is configured with microstrip line type half-wavelength resonators formed on a base 303. According to the filter of FIG. 9, coupling resonators 305, 306, 307 and 308 and coupling resonators 309 and 310 are used, and the filter property can be realized by various coupling methods. A transmission line of half-wave length is used for a delay circuit 304. By this configuration, the resonators 310 and 308 having resonance frequencies f2 and f4 respectively realize a phase difference of 180 degrees with respect to the resonators 305, 307 and 309 having resonance frequencies f1, f3 and f5 respectively. The electric energy supplied from the input terminal 301 is supplied to the resonators via branches of power distribution respectively. The branched power energies are combined via the branches and output to an output terminal 302. Impedance matching in the branches is realized by changing the width of the microstrip line as shown in FIG. 9.

Figure 10:
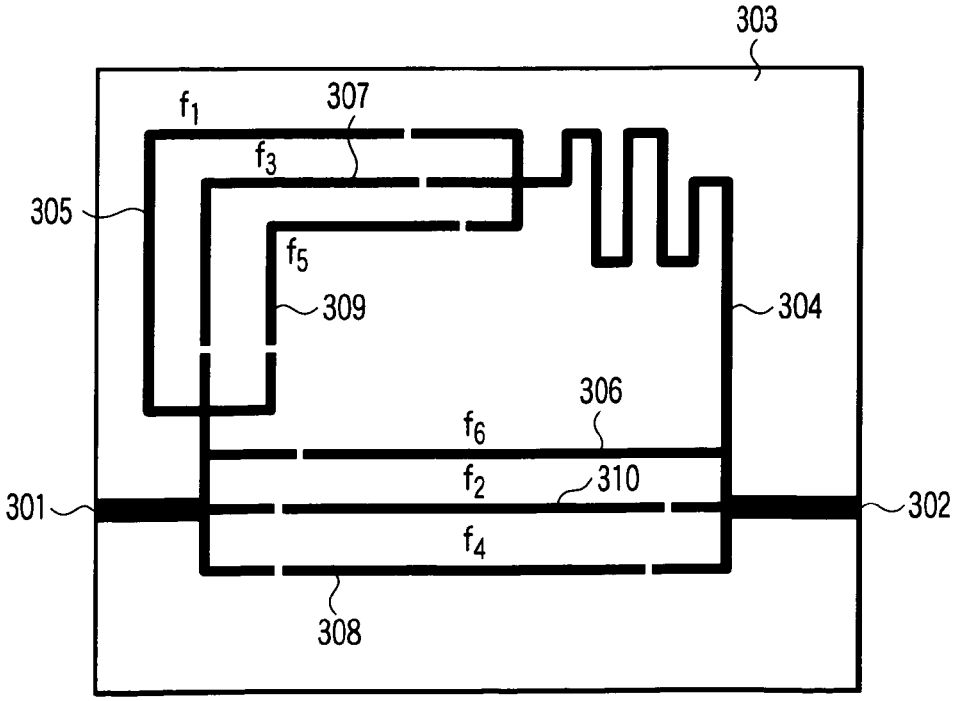
FIG. 10 shows a configuration of a filter circuit of the second concrete example of the third embodiment.

It is effective to realize a large delay quantity by using a meander-line for the delay circuit 304 as shown in FIG. 10. The order of resonance frequencies of the resonators 305, 310, 307, 308, 309 and 306 may be set arbitrarily if the above delay difference condition is satisfied. The present invention is applied to a resonator configured with resonator circuits of different shapes or a resonator configured with combination of a distributed constant circuit, a lumped constant circuit and a three-dimensional circuit which are connected in parallel.

Figure 11:
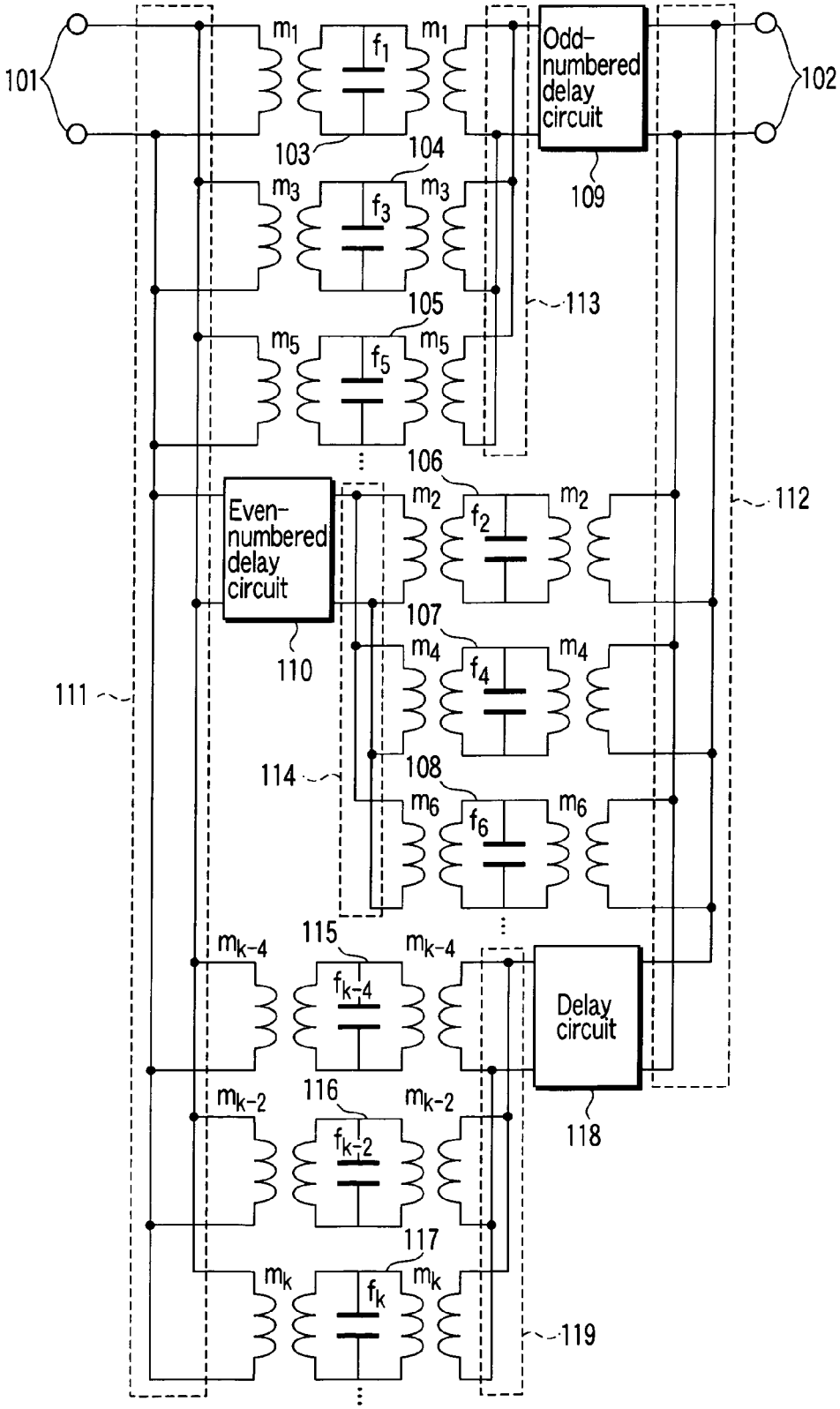
FIG. 11 is a circuit diagram of a filter circuit of the fourth embodiment.

FIG. 11 shows a filter circuit related to the fourth embodiment of the present invention. FIG. 11 shows an example wherein the delay circuit 110 of the filter circuit of FIG. 6 is provided on the input side of the resonator. In other words, according to the filter circuit of FIG. 11, delay circuits 109 and 118 are connected to the output ports of the resonator group of resonators 103, 104 and 105 and the resonator group of resonators 115, 116 and 117 via power combining circuits 113 and 119 respectively. The delay circuit 110 is connected to the input port of the resonator group of resonators 106, 107 and 108 via a power dividing circuit 114. This delay circuit 110 is connected to a power dividing circuit 111. The output port of the resonator group of resonators 106, 107 and 108 is connected to the power combining circuit 112. In other words, in the present embodiment, the delay circuits 109, 110 and 118 are provided mixed on the input and output sides of the resonator groups.

Figure 12:
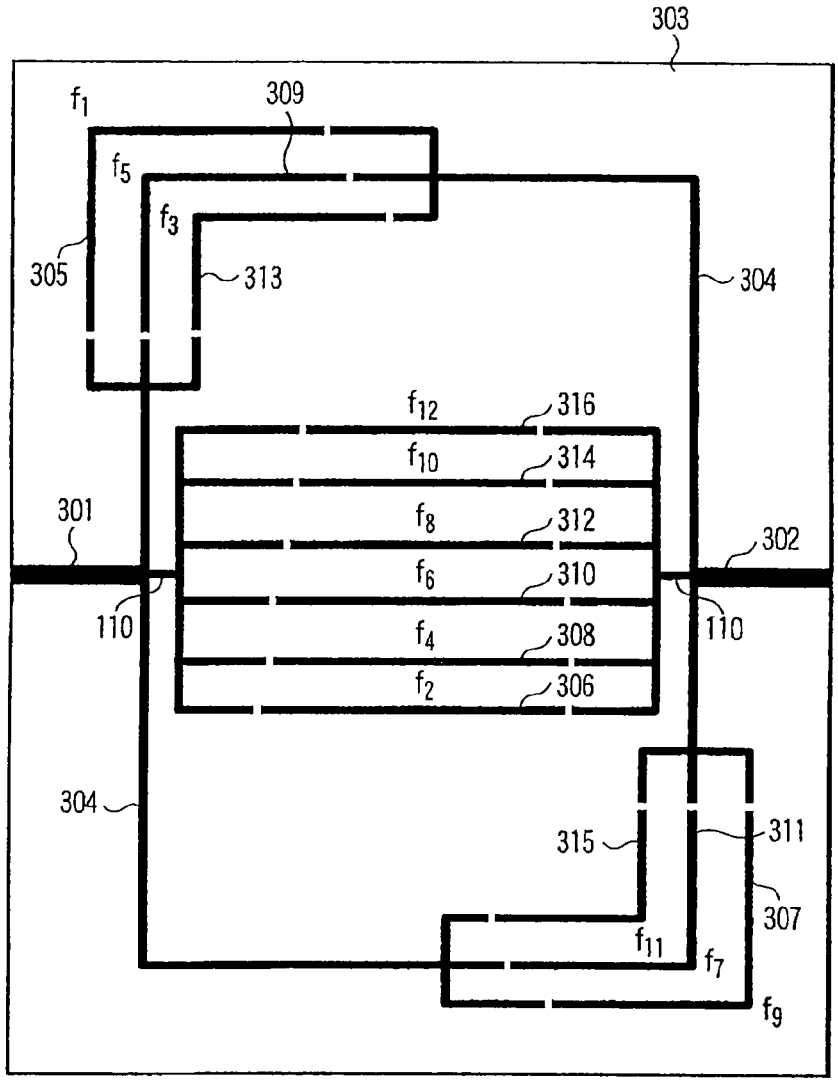
FIG. 12 shows a configuration of a concrete filter circuit of the fourth embodiment.

FIG. 12 shows a concrete circuit of the filter circuit of the fourth embodiment of FIG. 11. According to this circuit, it is effective to realize a large delay quantity by using a meander-line for the delay circuit 304. The resonance frequencies f1, f2, f3, f4, f5, f6, f7, f8, f9, f10, f11, and f12 of the resonators 305, 306, 313, 308, 309, 310, 311, 312, 307, 314, 315 and 316 may be set arbitrarily in order if the above delay difference condition is satisfied. The present invention is applied to a resonator configured with resonator circuits of different shapes or a resonator configured with combination of a distributed constant circuit, a lumped constant circuit and a three-dimensional circuit which are connected in parallel.

Figure 13:
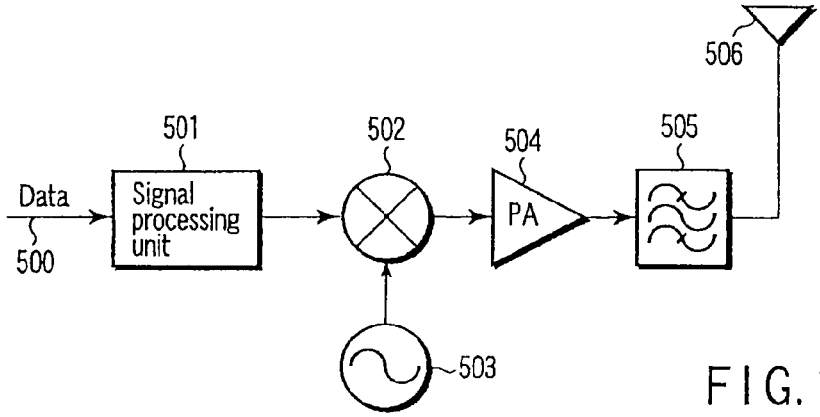
FIG. 13 is a block diagram showing a transmitter of a radio communication apparatus using the filter circuit.

An example applying the filter circuit to a radio communication apparatus is explained referred to FIG. 13. FIG. 13 illustrates diagrammatically a transmitter of the radio communication apparatus. Transmitting data 500 is input to a signal processing circuit or unit 501 and subjected to processes such as DA conversion, encoding and modulation to produce a transmission signal of a baseband or an IF (Intermediate Frequency) band. The transmission signal from the signal processing circuit 501 is input to a frequency mixer 502 and multiplied by a local signal from a local signal generator 503. Thereafter, the transmission signal is frequency-converted into a signal of a RF (Radio Frequency) band, that is, up-converted.

The RF signal is amplified with a power amplifier (PA) 504 and then input to a band limiting filter (a transmission filter) 505. The amplified RF signal is band-limited to remove an unnecessary frequency component, and then supplied to an antenna 506. The band limiting filter 505 can use a filter circuit explained in the above embodiments.

According to the filter circuit configured as described above, since a power is distributed to the resonators connected in parallel and the distributed powers are combined again, even if the resonators each have a small power handling capability, the whole of the filter circuit can have a large power handling capability. Also, the present filter can be configured with a distributed constant circuit and a lumped constant circuit which make it possible to comprise a small size filter. The filter circuit having a small size and a large power handling capability can be provided by the above configuration.

According to the present invention, there is provided a small type filter having a large power handling capability by combining powers passing through the resonators connected in parallel and fewer delay circuits in comparison with the conventional filter.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter circuit device passing through a desired frequency band, comprising:

a resonator unit configured with six or more resonators having ordered resonance frequencies respectively, the resonators being divided into a plurality of resonator groups, each resonator group including one or more resonators of the resonators connected in parallel, one resonator group of the resonators having different odd-numbered resonance frequencies, respectively, and another resonator group of the resonators having different even-numbered resonance frequencies, respectively, the resonators of each of the resonator groups having two or more different coupling factors, respectively;

a delay unit including a plurality of delay circuits each connected in cascade with the corresponding one of the resonator groups, each of the delay circuits being connected in common to the resonators of a corresponding one of the resonator groups, the delay circuits respectively including one or more delay circuits indicating different electric lengths with respect to the different odd-numbered resonance frequencies, respectively, and one or more delay circuits indicating different electric lengths with respect to the different even-numbered resonance frequencies, respectively;

a power dividing unit configured to divide a power to the resonators; and a plurality of power combining units provided for the first resonator group and the second resonator group, respectively, one of the plurality of power combining units combines outputs of the resonators of one of the resonator groups and another of the plurality of power combining units outputs of the resonators of another of the resonator groups, the phase difference being made between the resonator groups by the delay unit, wherein the resonators having the ordered resonance frequencies respectively are divided into three or more resonator groups each having one or more resonators without mixing the resonators having the odd-numbered resonance frequencies and the resonators having the even-numbered resonance frequencies, the resonators of each group of the resonator groups are connected in parallel in the group, and connected in cascade to the delay unit.

2. A radio communication apparatus comprising a power amplifier which amplifies a high frequency signal, the filter circuit device of claim 1 which has an input terminal connected to an output terminal of the power amplifier, and an antenna connected to an output terminal of the filter circuit device.

3. The filter circuit device according to claim 1, wherein the delay unit is formed of a meander-line.

4. The filter circuit device according to claim 1, wherein the plurality of delay circuits of the delay unit comprises a first delay circuit connected to an input port of at least one group of the resonator groups and a second delay circuit connected to an output port of other group of the resonator groups.

5. The filter circuit device according to claim 1, wherein all the resonators comprise end couple type coupling resonators.

6. The filter circuit device according to claim 1, wherein each of the resonator groups is configured with a group of resonators having resonance frequencies between which a maximum amplitude difference is within 3 dB defined in each of the resonator groups by the delay unit.

7. The filter circuit device according to claim 1, wherein all the resonators each comprise a microstrip line type half-wavelength resonator.

* * * * *